US010728672B2

(12) United States Patent
Kim et al.

(10) Patent No.: US 10,728,672 B2
(45) Date of Patent: Jul. 28, 2020

(54) SOUND CONVERTER

(71) Applicant: EM-TECH. Co., Ltd., Busan (KR)

(72) Inventors: Cheon Myeong Kim, Gyeongsangnam-do (KR); Sung Chul Jung, Gyeongsangnam-do (KR); Seul Ki Nam, Gyeongsangnam-do (KR); Gyung Bo Ha, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 0 days.

(21) Appl. No.: 16/136,921

(22) Filed: Sep. 20, 2018

(65) Prior Publication Data

US 2019/0104369 A1 Apr. 4, 2019

(30) Foreign Application Priority Data

Sep. 29, 2017 (KR) ..... 10-2017-0126716
Nov. 6, 2017 (KR) ..... 10-2017-0146717

(51) Int. Cl.
*H04R 9/04* (2006.01)
*H04R 9/02* (2006.01)
(Continued)

(52) U.S. Cl.
CPC ..... *H04R 9/043* (2013.01); *H04R 9/022* (2013.01); *H04R 9/045* (2013.01); *H04R 31/006* (2013.01); *H04R 7/04* (2013.01); *H04R 7/20* (2013.01); *H04R 9/025* (2013.01); *H04R 9/06* (2013.01); *H04R 31/003* (2013.01)

(58) Field of Classification Search
CPC ..... H04R 9/043; H04R 9/045; H04R 9/046; H04R 9/06; H04R 7/16; H04R 7/04; H04R 7/20; H04R 31/003; H04R 31/006
See application file for complete search history.

(56) References Cited

U.S. PATENT DOCUMENTS 9,025,808 B2 5/2015 Kwon et al.
9,813,821 B1 * 11/2017 Song ..... H04R 9/06
(Continued)

FOREIGN PATENT DOCUMENTS

CN 205847583 U 12/2016
KR 101200435 B1 11/2012
KR 101770378 B1 8/2017

*Primary Examiner* — Fan S Tsang
*Assistant Examiner* — Angelica M McKinney
(74) *Attorney, Agent, or Firm* — Murphy, Bilak & Homiller, PLLC

(57) ABSTRACT

A sound converter includes a rectangular frame, a first suspension seated on an upper side of the frame to vibrate, a second suspension attached to a bottom surface of the first suspension and electrically connected to a voice coil to vibrate, a magnetic circuit including a center magnet, a plurality of sub-magnets spaced apart from the center magnet by a certain distance to define a magnetic gap, a plurality of top plates positioned above the center magnet and each sub-magnet, and a bottom plate positioned below the center magnet and each sub-magnet, and a third suspension connecting a lower end or a lower end lateral surface of the voice coil to the frame to vibrate. The voice coil is attached to a bottom surface of the second suspension. The third suspension is positioned through spaces defined by the sub-magnets being spaced apart from each other.

12 Claims, 8 Drawing Sheets

(51) Int. Cl.

| | |
|---|---|
| ***H04R 31/00*** | (2006.01) |
| ***H04R 9/06*** | (2006.01) |
| ***H04R 7/04*** | (2006.01) |
| ***H04R 7/20*** | (2006.01) |

(56) References Cited

U.S. PATENT DOCUMENTS

| | | | | |
|---|---|---|---|---|
| 10,341,779 | B2 | 7/2019 | Li et al. | |
| 2011/0075880 | A1* | 3/2011 | Kamimura | H04R 1/06 381/413 |
| 2018/0027335 | A1* | 1/2018 | Li | H04R 7/127 381/398 |
| 2018/0332397 | A1* | 11/2018 | Kim | H04R 7/127 |

* cited by examiner

[FIG.1]
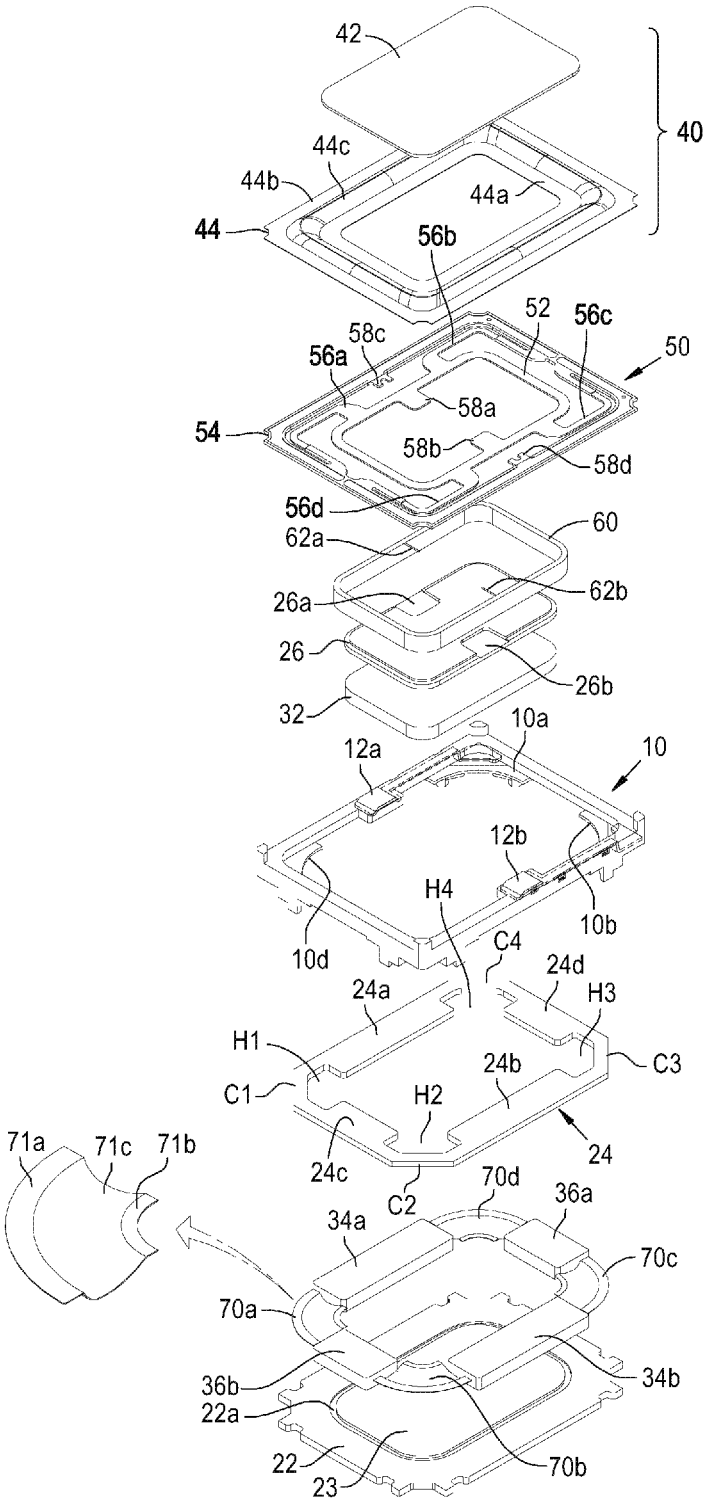

[FIG.2]
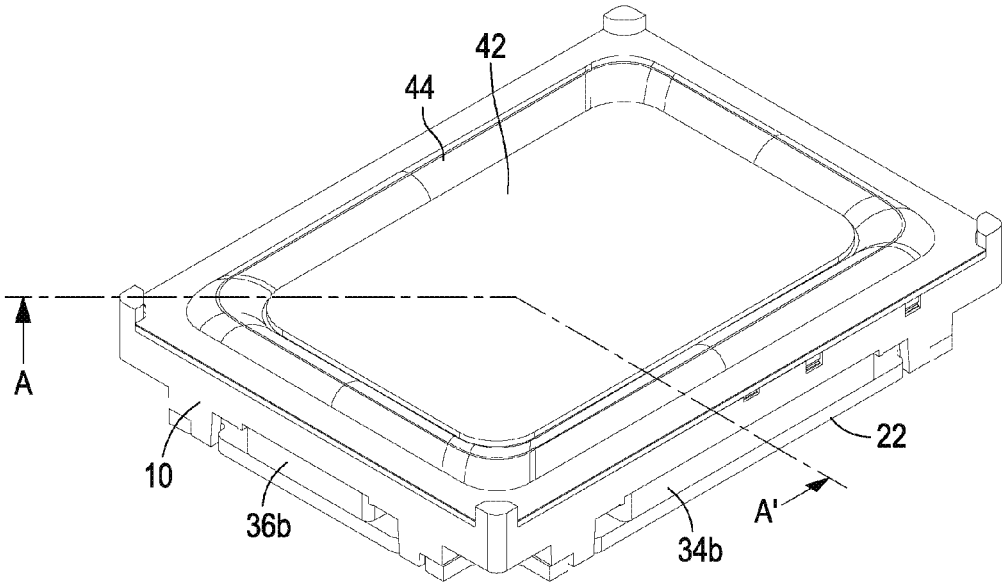

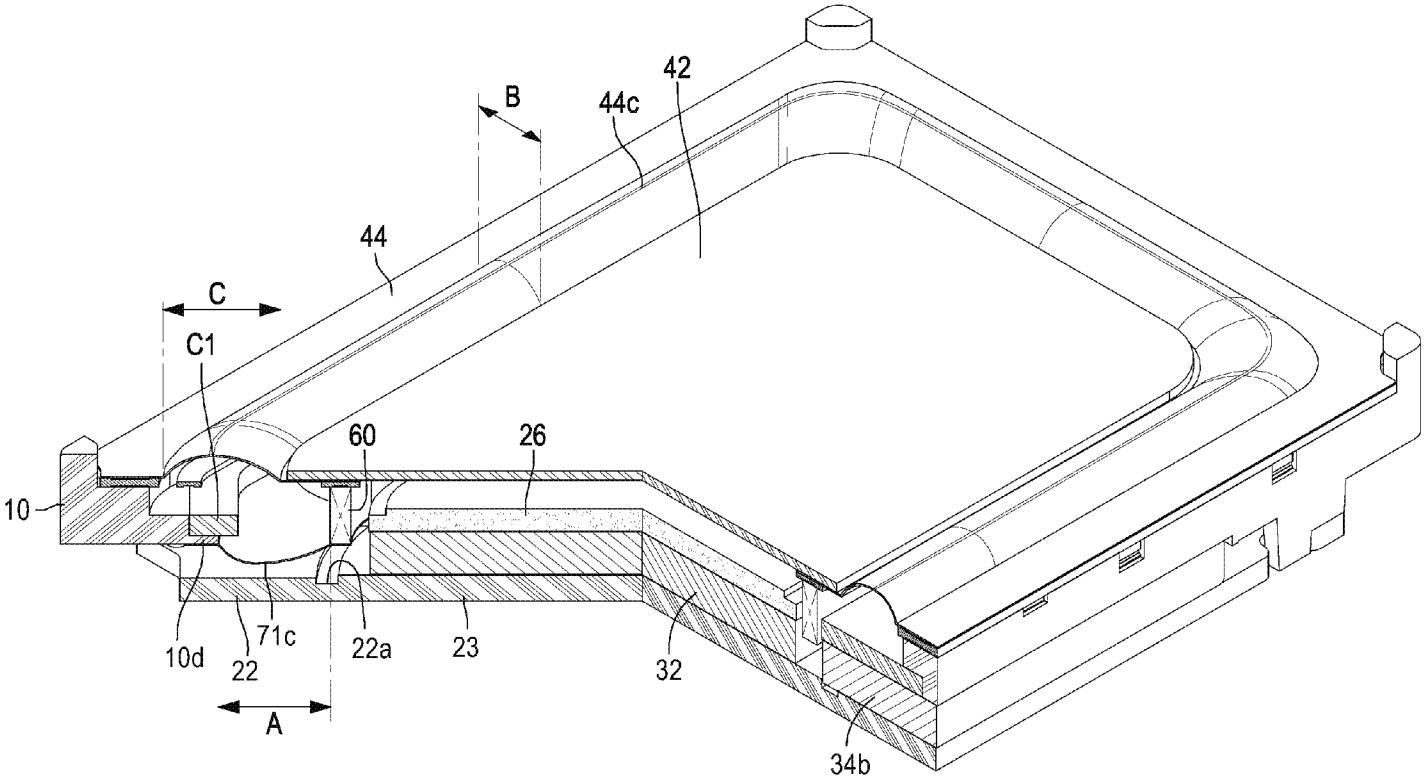
[FIG. 3]

[FIG.4A]
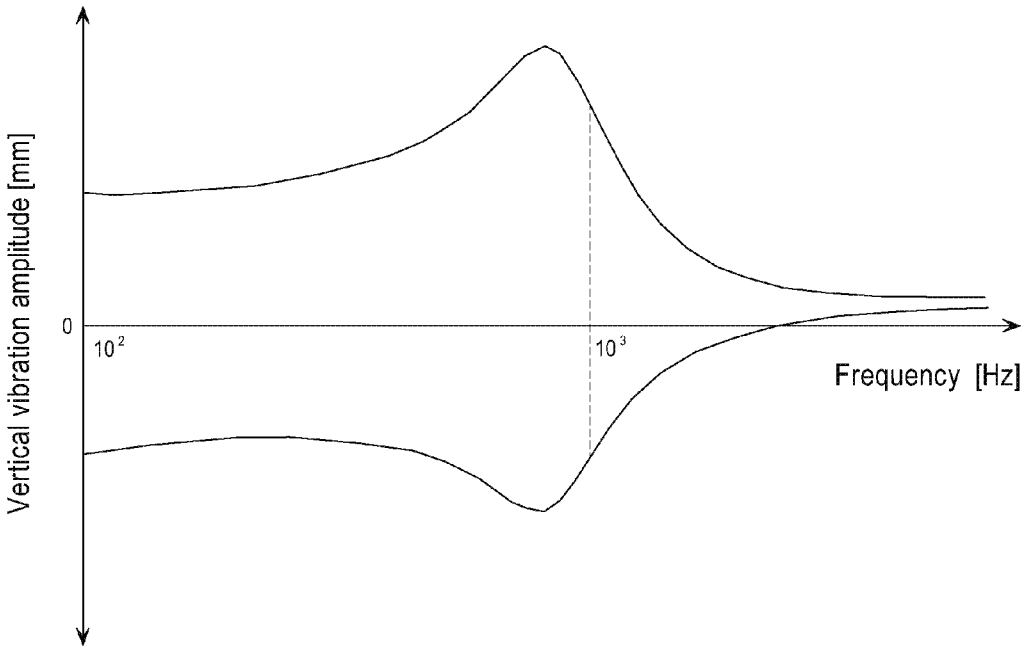
[FIG.4B]
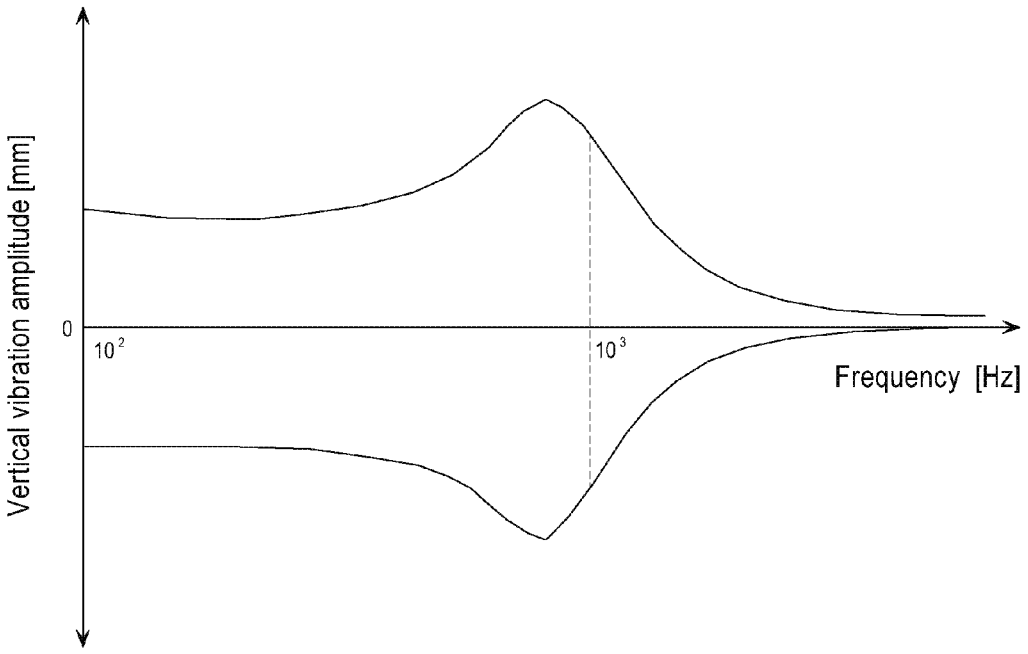

[FIG.5A]
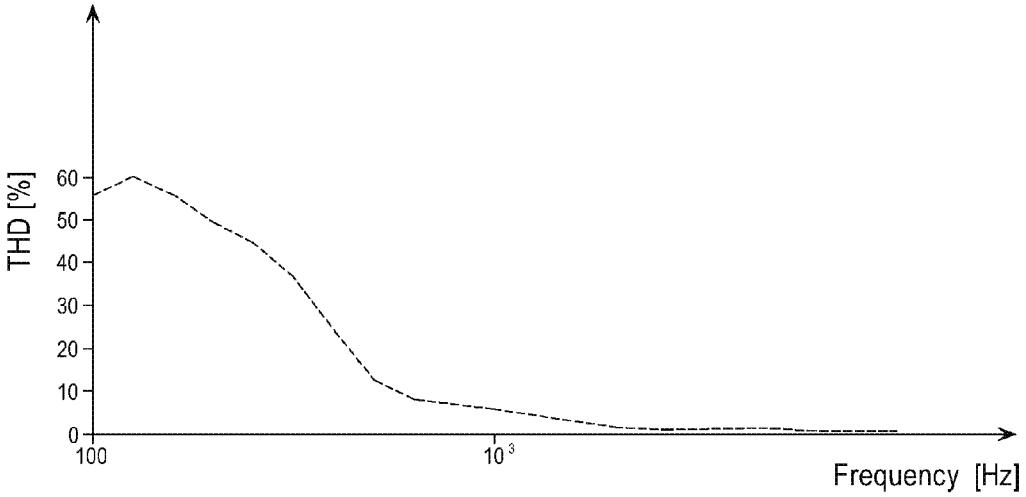
[FIG.5B]
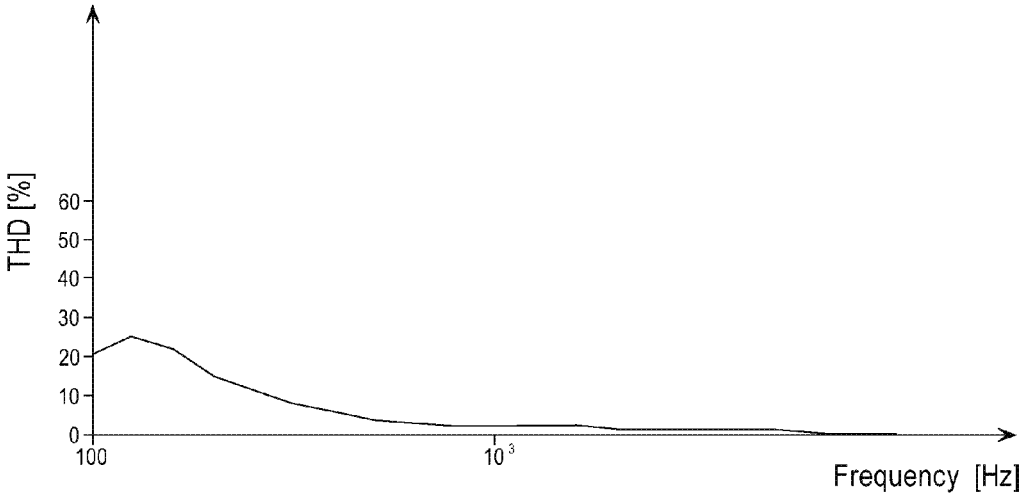

[FIG.6A]
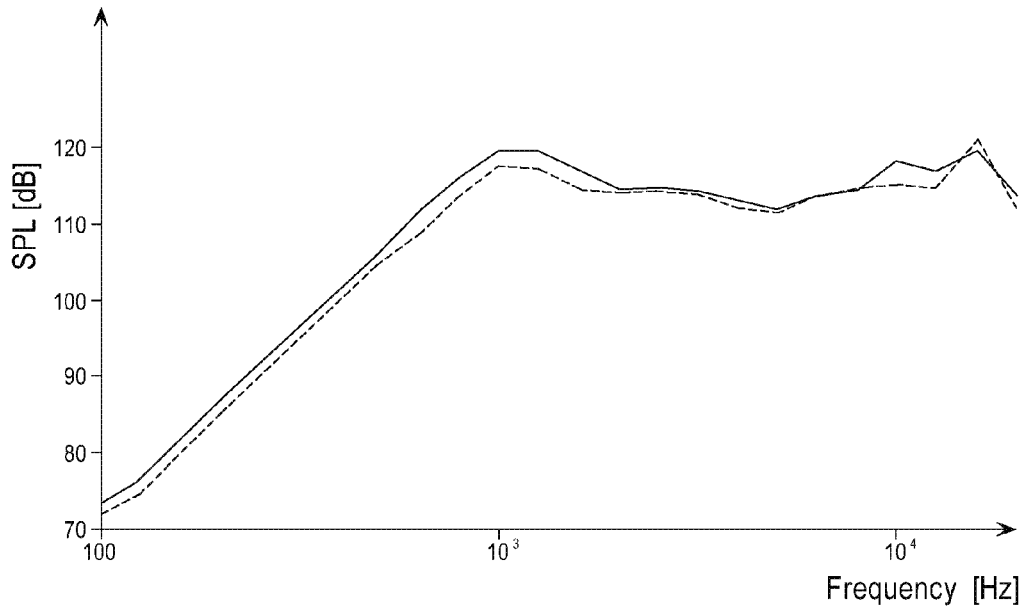
[FIG.6B]
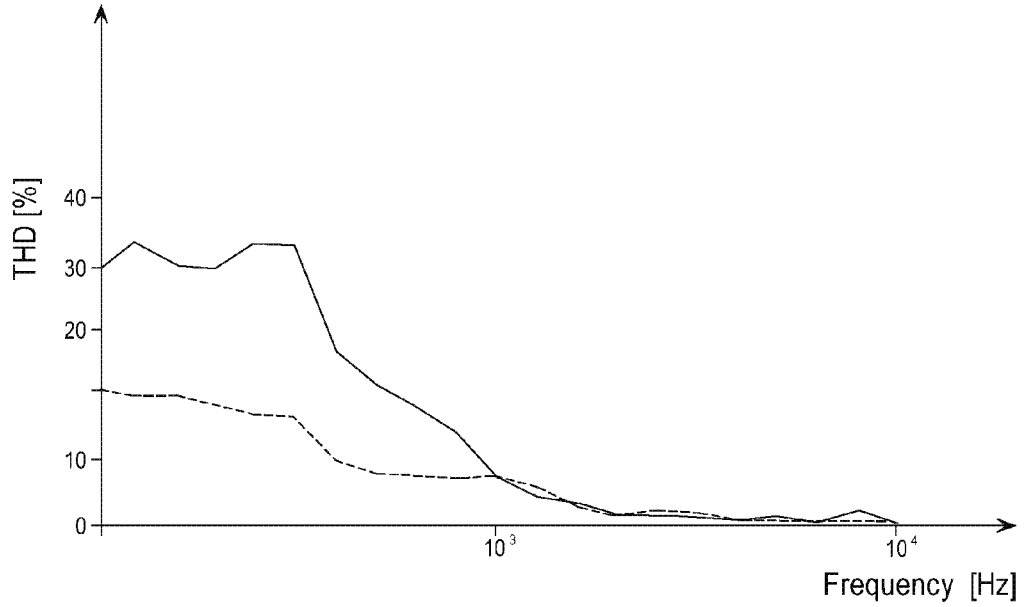

[FIG.6C]
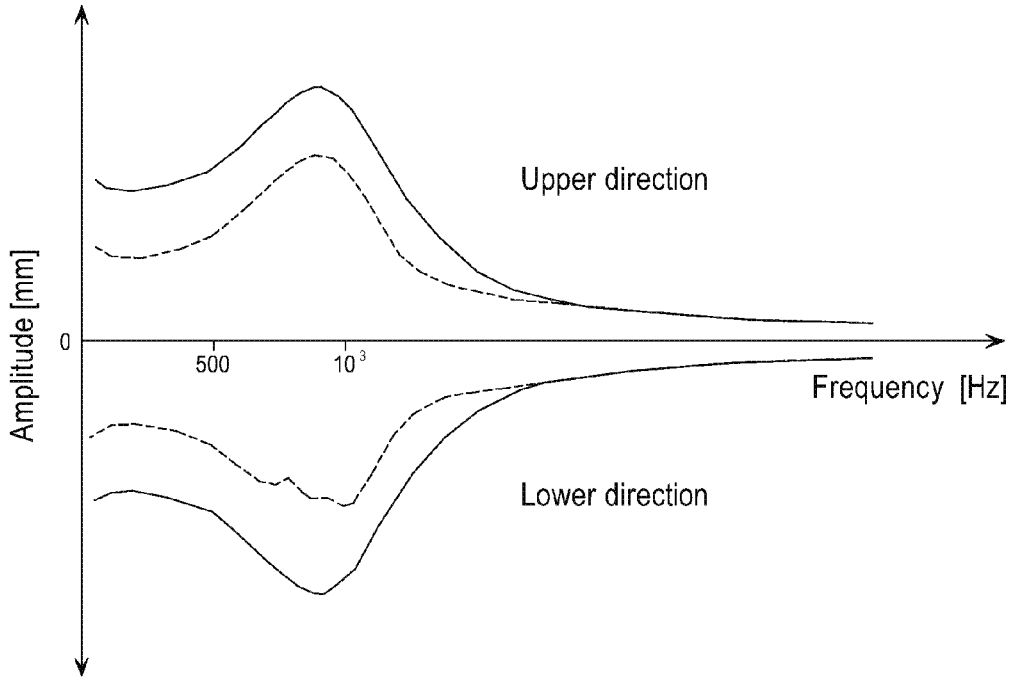
[FIG.7A]
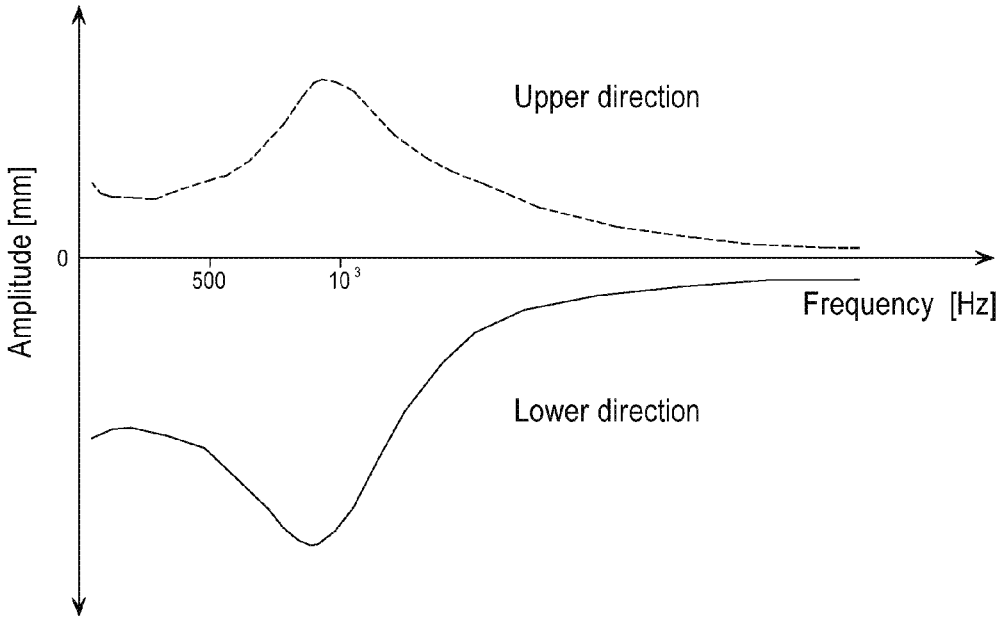

[FIG.7B]
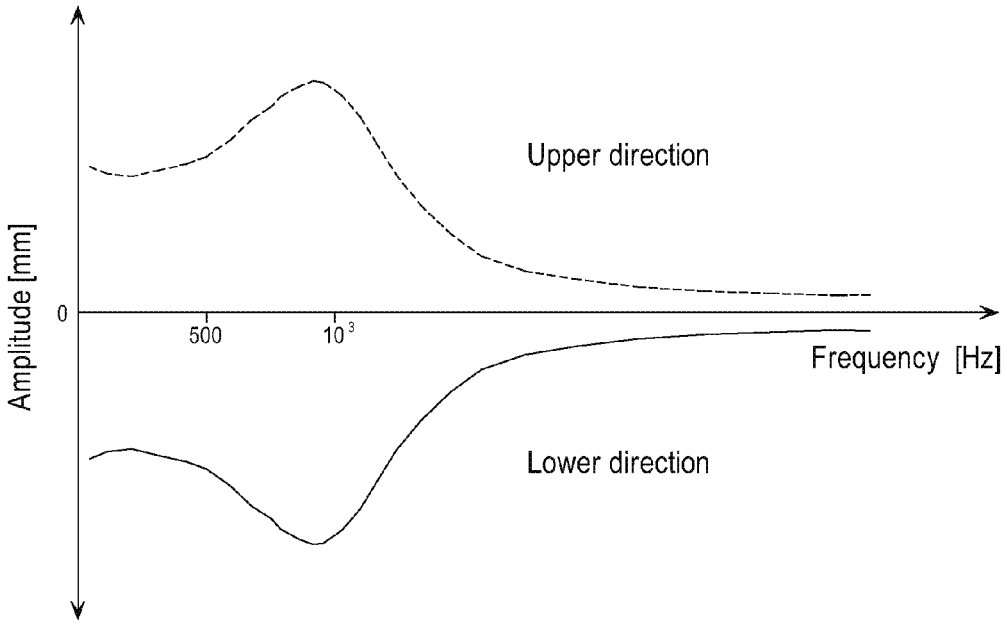

SOUND CONVERTER

PRIORITY CLAIM

The present application claims priority to Korean Patent Application No. 10-2017-0146717 filed on 6 Nov. 2017 and to Korean Patent Application No. 10-2017-0126716 filed on 29 Sep. 2017, the content of said applications incorporated herein by reference in their entirety.

TECHNICAL FIELD

The present invention relates to a sound converter, and more particularly, to a sound converter which includes a suspension for connecting a lower end or a lower end lateral surface of a voice coil to a frame to suppress split vibration.

BACKGROUND

A typical sound converter (for example, a microspeaker, etc.) does not use a broadband sound source due to communication technology limitations. However, with the development of the information communication technology, the reproduction bandwidth of the sound source to be reproduced in the sound converter has been widened, and with the increase of the required power, the structure of the typical sound converter has limitations in terms of characteristics and reliability.

In order to solve these problems, the present applicant filed and registered Korea Patent No. 10-1200435, entitled by "High power microspeaker" (hereinafter, referred to as 'the conventional patent'), which includes a frame, a protector, a yoke assembly coupled to the frame and having a magnet, a diaphragm disposed in the frame to generate vibration, a voice coil coupled to the diaphragm to vibrate the diaphragm, a terminal disposed at one side of the frame to provide electrical connection between a lead wire of the voice coil and an external terminal, and a damper formed of an FPCB having an inner part to which a center diaphragm, a side diaphragm and the voice coil are attached, an outer part to which the side diaphragm is attached and which is brought into contact with the frame and the protector, a support part which serves to connect the voice coil, the outer part and the inner part and which includes a land part to which a lead-in wire of the coil is soldered or welded, and a connection part which extends to the outside of the outer part and which provides electrical connection between the terminal disposed at the frame and the outer part.

The conventional patent of the present applicant has a limitation in suppressing split vibration because the vibration system is composed of the diaphragm, the damper formed of the FPCB and the voice coil, with a small distance between the diaphragm and the damper and with a relatively large distance to the lower end of the voice coil in which motion is generated by a magnetic force.

In addition, the conventional patent of the present applicant has a risk of thermal deformation because the fresh air does not smoothly flow into the diaphragm.

SUMMARY

An object of the present invention is to provide a sound converter which includes a suspension for connecting a lower end or a lower end lateral surface of a voice coil to a frame to suppress split vibration and which facilitates the internal flow of the air to reduce a temperature of a diaphragm.

A sound converter according to the present invention includes a frame, a bottom plate composed of an outer bottom plate and an inner bottom plate, a top plate composed of an outer top plate and an inner top plate, a center magnet mounted between the inner top plate and the inner bottom plate, first to fourth sub-magnets mounted between the outer top plate and the outer bottom plate and spaced apart from the center magnet by a certain distance (magnetic gap), a first suspension composed of a center dome and an edge dome mounted at the topmost portion of the frame, a second suspension composed of an FPCB and attached to a bottom surface of a diaphragm, a voice coil having a lower end positioned in the magnetic gap between the center magnet and the first to fourth sub-magnets and having an upper end attached to the bottom surface of the second suspension, and a third suspension composed of first to fourth dampers for connecting the lower end of the voice coil to the frame through the respective spaces between the first and second sub-magnets and the third and fourth sub-magnets.

According to the present invention, the vibration system is composed of the first suspension, the voice coil, the second suspension attached to the upper end of the voice coil, and the third suspension attached to the lower end or the lower end lateral surface of the voice coil, which suppresses split vibration.

In addition, according to the present invention, the plurality of open parts are formed at the corners of the outer top plate to facilitate the flow of the air in the sound converter, which reduces internal heat, particularly upon high power application, to suppress deformation of the diaphragm and improve the THD.

Furthermore, according to the present invention, in the structure of the rectangular sound converter, it is possible to compensate for a difference in the rigidity of the diaphragm between the long side and the short side.

Those skilled in the art will recognize additional features and advantages upon reading the following detailed description, and upon viewing the accompanying drawings.

BRIEF DESCRIPTION OF THE DRAWINGS

The elements of the drawings are not necessarily to scale relative to each other. Like reference numerals designate corresponding similar parts. The features of the various illustrated embodiments can be combined unless they exclude each other. Embodiments are depicted in the drawings and are detailed in the description which follows.

FIG. 1 is an exploded perspective view of a sound converter according to the present invention.

FIG. 2 is a perspective view of the sound converter according to the present invention.

FIG. 3 is a sectional perspective view taken along line A-A' of FIG. 2.

FIGS. 4A and 4B are graphs showing vertical vibration amplitudes of the vibration systems of the conventional art and the present invention.

FIGS. 5A and 5B are graphs showing the THD of the sound converters of the conventional art and the present invention.

FIGS. 6A to 6C are graphs showing the relationship between a corner width A of a damper part 71*c* and a width B of a long axis or short axis straight part of a dome 44*c*.

FIGS. 7A and 7B are graphs showing the relationship between the corner width A of the damper part 71*c* and a corner width C of a connection part between the long axis straight part and the short axis straight part of the dome 44*c*.

DETAILED DESCRIPTION

Hereinafter, preferred embodiments of a sound converter according to the present invention will be described in detail with reference to the accompanying drawings.

FIG. 1 is an exploded perspective view of a sound converter according to the present invention, FIG. 2 is a perspective view of the sound converter according to the present invention, and FIG. 3 is a sectional perspective view taken along line A-A' of FIG. 2.

The sound converter includes a frame 10, a bottom plate mounted on the bottom surface of the frame 10 and composed of an outer bottom plate 22 and an inner bottom plate 23, a top plate composed of an outer top plate 24 and an inner top plate 26, a center magnet 32 mounted between the inner top plate 26 and the inner bottom plate 23, first to fourth sub-magnets 34*a*, 34*b*, 36*a* and 36*b* separately mounted between the outer top plate 24 and the outer bottom plate 22 and spaced apart from the center magnet 32 by a certain distance (magnetic gap), a first suspension 40 composed of a center dome 42 and an edge dome 44 mounted at the topmost portion of the frame 10 to vibrate, a second suspension 50 composed of, e.g., an FPCB or the like and attached to the bottom surface of the diaphragm 40 to vibrate, a voice coil 60 having a lower end positioned in the magnetic gap between the center magnet 32 and the first to fourth sub-magnets 34*a*, 34*b*, 36*a* and 36*b* and having an upper end attached to the bottom surface of the second suspension 50, and a third suspension composed of first to fourth dampers 70*a* to 70*d* for connecting the lower end of the voice coil 60 to the frame 10 through the respective spaces between the first and second sub-magnets 34*a* and 34*b* and the third and fourth sub-magnets 36*a* and 36*b* to vibrate. The sound converter according to the present invention includes a vibration system composed of the voice coil 60, the first and second suspensions 40 and 50 attached to the upper end of the voice coil 60, and the third suspension. The sound converter according to the present invention includes a magnetic circuit composed of the top plate, the bottom plate, and the magnet (center magnet 32) and the first to fourth sub-magnets 34*a*, 34*b*, 36*a* and 36*b* mounted between the top plate and the bottom plate to define the magnetic gap.

More specifically, the frame 10 has a hollow rectangular structure. The combined first suspension 40 and second suspension 50 are seated on the top surface of the frame 10, the outer top plate 24 is seated on the top surfaces of the four corners thereof, and first to fourth seating parts 10*a* to 10*d* to which one end of the first to fourth dampers 70*a* to 70*d* is attached are provided on the insides or the inside bottom surfaces of the four corners thereof. In addition, the frame 10 includes first and second terminals 12*a* and 12*b* for receiving an electric signal from a controller (not shown; e.g., a microprocessor, etc.) of the electronic equipment.

The bottom plate is composed of the outer bottom plate 22 and the inner bottom plate 23 formed in a single piece with a groove 22*a* therebetween. The groove 22*a* serves to prevent the voice coil 50 from hitting the bottom plate upon vibration. The first and second sub-magnets 34*a* and 34*b* are in parallel attached to the long axes of the outer bottom plate 22 separately, and the third and fourth sub-magnets 36*a* and 36*b* are in parallel attached to the short axes of the outer bottom plate 22 separately.

The top plate is composed of the outer top plate 24 and the inner bottom plate 26 spaced apart from each other by at least a magnetic gap. The outer top plate 24 includes first and second long axis parts 24*a* and 24*b* which are parallel to each other, the first and second sub-magnets 34*a* and 34*b* being attached to the bottom surfaces thereof, first and second short axis parts 24*c* and 24*d* which are parallel to each other, the third and fourth sub-magnets 36*a* and 36*b* being attached to the bottom surfaces thereof, and first to fourth connection parts C1 to C4 (i.e., the respective corners of the outer top plate 24) which connect the first and second long axis parts 24*a* and 24*b* to the first and second short axis parts 24*c* and 24*d*, respectively, first to fourth open parts H1 to H4 being formed in the first to fourth connection parts C1 to C4. The first to fourth open parts H1 to H4 serve to facilitate the flow of the air between the inside of the second suspension 50 and the bottom of the second suspension 50 to reduce internal heat even when an electric signal for high output is applied to the voice coil 60, which suppresses deformation of the diaphragm and improves the THD. Moreover, first and second grooves 26*a* and 26*b* are formed on the long axis sides of the inner top plate 26 to prevent the second suspension 50 from hitting first and second projections 58*a* and 58*b* upon vibration.

The center magnet 32 is seated at the center of the outer top plate 24 and the outer bottom plate 23, and the first to fourth sub-magnets 34*a*, 34*b*, 36*a* and 36*b* are mounted to be spaced apart from the outer lateral surface of the center magnet 32 by the magnetic gap. In addition, the first sub-magnet 34*a* is spaced apart from the third and fourth sub-magnets 36*a* and 36*b* by distances corresponding to the first and fourth connection parts C1 and C4 or by the first and fourth open parts H1 and H4, and the second sub-magnet 34*b* is spaced apart from the third and fourth sub-magnets 36*a* and 36*b* by distances corresponding to the second and third connection parts C2 and C3 or by the second and third open parts H2 and H3. In this embodiment, the first to fourth sub-magnets 34*a*, 34*b*, 36*a* and 36*b* are provided corresponding to the four sides of the center magnet 32. However, it would be also possible for only the first and second sub-magnet 34*a* and 34*b* to be provided corresponding to the long axis sides of the center magnet 32 or for only the third and fourth sub-magnets 36*a* and 36*b* to be provided corresponding to the short axis sides of the center magnet 32.

The first suspension 40 is composed of the center dome 42 and the edge dome 44 which includes a first seating part 44*a* on which the outer peripheral part of the center dome 42 is seated, a second seating part 44*b* seated on the frame 10, and a dome 44*c* interposed between the first seating part 44*a* and the second seating part 44*b*.

The second suspension 50 is composed of an inner peripheral part 52 attached to the bottom surface of the first seating part 44*a*, an outer peripheral part 54 attached to the bottom surface of the second seating part 44*b*, first to fourth bridges 56*a* to 56*d* for connecting the inner peripheral part 52 to the outer peripheral part 54, first and second projections 58*a* and 58*b* projecting from the long axis sides of the inner peripheral part 52 in the center direction, and third and fourth projections 58*c* and 58*d* projecting from the long axis sides of the outer peripheral part 54 in the center direction, between the outer peripheral part 54 and the inner peripheral part 52. The inner peripheral part 52 includes first and second conductive parts (not shown) electrically isolated from each other, the first conductive part being electrically connected to a first lead-out wire 62*a* of the voice coil 60 through the first projection 58*a* with conductivity, the second conductive part being electrically connected to a second lead-out wire 62*b* of the voice coil 60 through the second projection 58*b* with conductivity. The outer peripheral part 54 includes third and fourth conductive parts (not shown) electrically isolated from each other, the third conductive part being electrically connected to the first terminal 12*a* brought into electrical contact with the third projection 58*c* with conductivity, the fourth conductive part being electrically connected to the second terminal 12*b* brought into electrical contact with the fourth projection 58*d* with conductivity. The first conductive part and the third conductive part are electrically connected through one of the first and second bridges 56*a* and 56*b* with conductivity, and the second conductive part and the fourth conductive part are electrically connected through one of the third and fourth bridges 56*c* and 56*d* with conductivity. Also, the first to fourth bridges 56*a* to 56*d* serve to connect the short axis inside of the outer peripheral part 54 to the long axis outside of the inner peripheral part 52 or to connect the long axis inside of the outer peripheral part 54 to the short axis outside of the inner peripheral part 52, such that the first to fourth bridges 56*a* to 56*d* are equally disposed in the long axis and short axis directions to prevent the inner peripheral part 52 from being rotated or twisted in long axis and short axis directions, even when a high power signal is applied to the voice coil 60, thereby preventing split vibration upon vertical vibration of the voice coil 60.

The voice coil 60 may be wound around a voice coil bobbin, the upper end of the voice coil being attached to the bottom surface of the inner peripheral part 52 of the second suspension 50, the lower end thereof being positioned in the magnetic gap.

The third suspension is composed of the first to fourth dampers 70*a* to 70*d*, each of them including a first attachment part 71*a* attached to the bottom surface of each of the first to fourth seating parts 10*a* to 10*d*, a second attachment part 71*b* attached to the lower end or lower end lateral surface of the voice coil 60, and a damper part 71*c* for connecting the first attachment part 71*a* to the second attachment part 71*b*. The first to fourth dampers 70*a* to 70*d* are positioned in or below the spaces in which the first to fourth open parts H1 to H4 are formed. The lower end of the voice coil 60 is connected to the frame 10 below the first to fourth open parts H1 to H4, which equalizes vertical vibration amplitudes of the vibration system to prevent split vibration and which suppresses an increase of harmonic components to reduce the total harmonic distortion (THD).

Further, in the present embodiment, the damper part 71*c* has a dome structure facing the downward direction of the frame 10, but it may extend almost horizontally between the lower end of the voice coil 60 and the frame 10, with a plurality of bends (wave form), or it may extend convexly in the downward direction of the frame 10, with a plurality of bends (wave form).

FIGS. 4A and 4B are graphs showing vertical vibration amplitudes of the vibration systems of the conventional art and the present invention. The vertical vibration amplitude graph of the conventional art in FIG. 4A shows an amplitude up to about 0.35 mm according to a frequency of an electric signal applied upon vertical vibration, while the vertical vibration amplitude graph of the present invention in FIG. 4B shows an amplitude up to about 0.29 mm according to a frequency of an electric signal applied upon vertical vibration. In FIGS. 4A and 4B, it can be seen that the provision of the third suspension equalizes vertical vibration amplitudes of the vibration system to suppress split vibration.

FIGS. 5A and 5B are graphs showing the THD of the sound converters of the conventional art and the present invention. The THD graph of the vibration system of the conventional art in FIG. 5A shows that the THD is up to about 60% at a low frequency band according to a frequency of an electric signal applied upon vertical vibration, while THD graph of the vibration system of the present invention in FIG. 5B shows that the THD is up to about 25% at a low frequency band according to a frequency of an electric signal applied upon vertical vibration. In FIGS. 5A and 5B, it can be seen that the provision of the third suspension suppresses an increase of harmonic components to considerably reduce the THD.

In FIG. 3, a corner width A of the damper part 71*c*, which is provided in the first to fourth dampers 70*a* to 70*d*, a width B of the long axis or short axis straight part of the dome 44*c*, and a corner width C of the connection part between the long axis straight part and the short axis straight part of the dome 44*c* have an influence on the vibration control of the vibration system. It is preferable to satisfy at least one of the following expressions 1 and 2 to equally control vertical vibration amplitudes of the vibration system.

$$A \geq B \qquad \text{Expression 1:}$$

$$A \leq C \qquad \text{Expression 2:}$$

First, regarding Expression 1, FIGS. 6A to 6C are graphs showing the relationship between the corner width A of the damper part 71*c* and the width B of the long axis or short axis straight part of the dome 44*c*.

FIG. 6A shows a sound pressure level (SPL), wherein the solid line graph is obtained when A≥B and the dotted line graph is obtained when A□B. As shown in FIG. 6A, it can be seen that the SPL (dB) of the solid line graph satisfying Expression 1 is higher than that of the dotted line graph at most of the frequency bands.

FIG. 6B shows the total harmonic distortion (THD), wherein the dotted line graph is obtained when A≥B and the solid line graph is obtained when A□B. As shown in FIG. 6B, it can be seen that the distortion rate (%) of the dotted line graph satisfying Expression 1 is much lower than that of the solid line graph below 1 kHz and similar to that of the solid line graph above 1 kHz.

FIG. 6C shows the amplitude of the vibration part, wherein the solid line graph is obtained when A≥B and the black dotted line graph is obtained when A□B. As shown in FIG. 6C, it can be seen that the amplitudes of the solid line graph satisfying Expression 1 are symmetrical on the upper and lower directions (i.e., the amplitudes are uniform in the vertical direction), while the amplitudes of the black dotted line graph are not uniform in the vertical direction at some frequency bands.

Based on the description of FIGS. 6A to 6C, it is preferable for the corner width A of the damper part 71*c* and the width B of the long axis or short axis lateral part of the dome 44*c* to satisfy Expression 1.

In turn, regarding Expression 2, FIGS. 7A and 7B are graphs showing the relationship between the corner width A of the damper part 71*c* and the corner width C of the connection part between the long axis straight part and the short axis straight part of the dome 44*c*.

FIG. 7A shows a graph obtained when the corner width A is larger than the corner width C. It can be seen that the upward vibration graph (dotted line) and the downward vibration graph (solid line) are not uniform, which results in split vibration.

FIG. 7B shows a graph obtained when the corner width A is equal to or smaller than the corner width C. It can be seen that the upward vibration graph (dotted line) and the downward vibration graph (solid line) are uniform, which prevents split vibration.

While the present invention has been illustrated and described in connection with the accompanying drawings and the preferred embodiments, the present invention is not limited thereto and is defined by the appended claims. Therefore, it will be understood by those skilled in the art that various modifications and changes can be made thereto without departing from the spirit and scope of the invention defined by the appended claims.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents

What is claimed is:

1. A sound converter, comprising:

a rectangular frame;

a first suspension seated on an upper side of the rectangular frame to vibrate;

a second suspension attached to a bottom surface of the first suspension and electrically connected to a voice coil to vibrate;

a magnetic circuit comprising a center magnet, a plurality of sub-magnets spaced apart from the center magnet by a certain distance to define a magnetic gap, a plurality of top plates positioned above the center magnet and each of the plurality of sub-magnets, and a bottom plate positioned below the center magnet and each of the plurality of sub-magnets; and a third suspension connecting a lower end or a lower end lateral surface of the voice coil to the frame to vibrate, wherein the voice coil is attached to a bottom surface of the second suspension, wherein the third suspension is positioned through spaces defined by the plurality of sub-magnets being spaced apart from each other, wherein the third suspension is composed of a plurality of dampers including a first attachment part attached to the bottom surface of the seating part of the frame, a second attachment part attached to the lower end or the lower end lateral surface of the voice coil, and a damper part for connecting the first attachment part to the second attachment part, wherein the first suspension is composed of a center dome positioned at the center and a first seating part on which the outer peripheral part of the center dome is seated, a second seating part seated on the frame, and an edge dome interposed between the first seating part and the second seating part, wherein a corner width of the damper part is greater than a width of a straight part of a dome of the edge dome.

2. The sound converter of claim 1 wherein the damper part has a dome structure facing a downward direction of the frame, a structure extending horizontally between the voice coil and the frame, with a plurality of bends, or a structure extending convexly in the downward direction of the frame between the voice coil and the frame, with a plurality of bends.

3. The sound converter of claim 1, wherein the plurality of top plates comprises an inner top plate attached to an upper side of the center magnet and an outer top plate spaced apart from the inner top plate by at least the magnetic gap, wherein the plurality of sub-magnets is attached to the outer top plate, and wherein an open part is formed in a corner of the outer top plate.

4. The sound converter of claim 3, wherein the third suspension is positioned in or below a space in which the open part is formed.

5. The sound converter of claim 1 wherein the second suspension comprises an inner peripheral part attached to the bottom surface of the first seating part, an outer peripheral part attached to the bottom surface of the second seating part, and a plurality of bridges for connecting the inner peripheral part to the outer peripheral part, each of the bridges connecting a short axis inside of the outer peripheral part to a long axis outside of the inner peripheral part.

6. The sound converter of claim 1, wherein the bottom plate comprises an inner bottom plate on which the center magnet is mounted and an outer bottom plate on which the plurality of sub-magnets is mounted, and wherein the inner and outer bottom plates are formed in a single piece with a groove therebetween.

7. A sound converter, comprising:

a rectangular frame;

a first suspension seated on an upper side of the rectangular frame to vibrate;

a second suspension attached to a bottom surface of the first suspension and electrically connected to a voice coil to vibrate, the voice coil being attached to the bottom surface of the second suspension;

a magnetic circuit comprising a center magnet, a plurality of sub-magnets spaced apart from the center magnet by a certain distance to define a magnetic gap, a plurality of top plates positioned above the center magnet and each of the plurality of sub-magnets, and a bottom plate positioned below the center magnet and each of the plurality of sub-magnets; and a third suspension connecting a lower end or a lower end lateral surface of the voice coil to the frame to vibrate, wherein the third suspension is positioned through the spaces defined by the plurality of sub-magnets spaced apart from each other, wherein the third suspension is composed of a plurality of dampers including a first attachment part attached to the bottom surface of the seating part of the frame, a second attachment part attached to the lower end or the lower end lateral surface of the voice coil, and a damper part for connecting the first attachment part to the second attachment part, wherein the first suspension is composed of a center dome positioned at the center and a first seating part on which the outer peripheral part of the center dome is seated, a second seating part seated on the frame, and an edge dome interposed between the first seating part and the second seating part, wherein a corner width of the damper part is smaller than a corner width of a connecting part between straight parts of a dome of the edge dome.

8. The sound converter of claim 7, wherein the damper part has a dome structure facing a downward direction of the frame, a structure extending horizontally between the voice coil and the frame, with a plurality of bends, or a structure extending convexly in the downward direction of the frame between the voice coil and the frame, with a plurality of bends.

9. The sound converter of claim 7, wherein the plurality of top plates comprises an inner top plate attached to an upper side of the center magnet and an outer top plate spaced apart from the inner top plate by at least the magnetic gap, wherein the plurality of sub-magnets is attached to the outer top plate, and wherein an open part is formed in a corner of the outer top plate.

10. The sound converter of claim 9, wherein the third suspension is positioned in or below a space in which the open part is formed.

11. The sound converter of claim 7, wherein the second suspension comprises an inner peripheral part attached to the bottom surface of the first seating part, an outer peripheral part attached to the bottom surface of the second seating part, and a plurality of bridges for connecting the inner peripheral part to the outer peripheral part, each of the bridges connecting a short axis inside of the outer peripheral part to a long axis outside of the inner peripheral part.

12. The sound converter of claim 7, wherein the bottom plate comprises an inner bottom plate on which the center magnet is mounted and an outer bottom plate on which the plurality of sub-magnets is mounted, and wherein the inner and outer bottom plates are formed in a single piece with a groove therebetween.

* * * * *